United States Patent [19]

Sauerschell et al.

[11] 4,450,804

[45] May 29, 1984

[54] APPARATUS FOR INCREASING IDLING SPEED

[75] Inventors: Wolfgang Sauerschell, Oberursel; Stephan Wietschorke, Schmitten; Gerhard Ruschek, Hattersheim, all of Fed. Rep. of Germany

[73] Assignee: VDO Adolf Schindling AG, Frankfurt am Main, Fed. Rep. of Germany

[21] Appl. No.: 481,306

[22] Filed: Apr. 1, 1983

[30] Foreign Application Priority Data

May 8, 1982 [DE] Fed. Rep. of Germany ..... 3217351

[51] Int. Cl.[3] ..... F02D 31/00

[52] U.S. Cl. ..... 123/366; 123/367; 123/368; 123/357; 123/339

[58] Field of Search ..... 123/368, 367, 369, 366, 123/339, 357

[56] References Cited

U.S. PATENT DOCUMENTS

| | | | |
|---|---|---|---|
| 3,699,941 | 10/1972 | Hughes et al. | 123/366 |
| 4,254,753 | 3/1981 | Ritter et al. | 123/366 |
| 4,353,340 | 10/1982 | Straubel et al. | 123/367 |
| 4,377,994 | 3/1983 | Lang | 123/368 |

FOREIGN PATENT DOCUMENTS

| | | | |
|---|---|---|---|
| 261034 | 5/1928 | United Kingdom | 123/368 |

*Primary Examiner*—Ira S. Lazarus
*Assistant Examiner*—Magdalen Moy
*Attorney, Agent, or Firm*—Martin A. Farber

[57] ABSTRACT

The invention relates to an arrangement for increasing the idling speed of an internal combustion engine, particularly a diesel internal-combustion engine. It has a setting member for controlling the feed of the fuel, the displacement path of said member being adapted to be limited in the direction towards idle by an idle stop and after a starting process, by a start-quantity stop. In order that such an arrangement be of simple construction and be capable of being manufactured inexpensively, the displacement path can be limited by a plurality of start-quantity stops arranged one behind the other in the idling direction, of which, commencing with the starting process, at given time intervals one after the other, the start-quantity stop furthest from the idle stop can be moved out of the path of displacement of the setting member.

20 Claims, 4 Drawing Figures

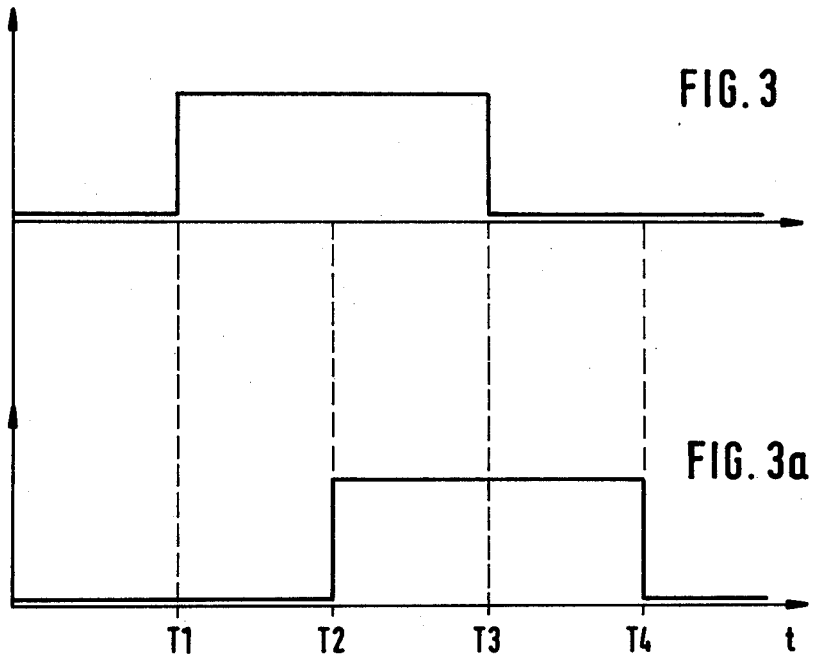
FIG. 4
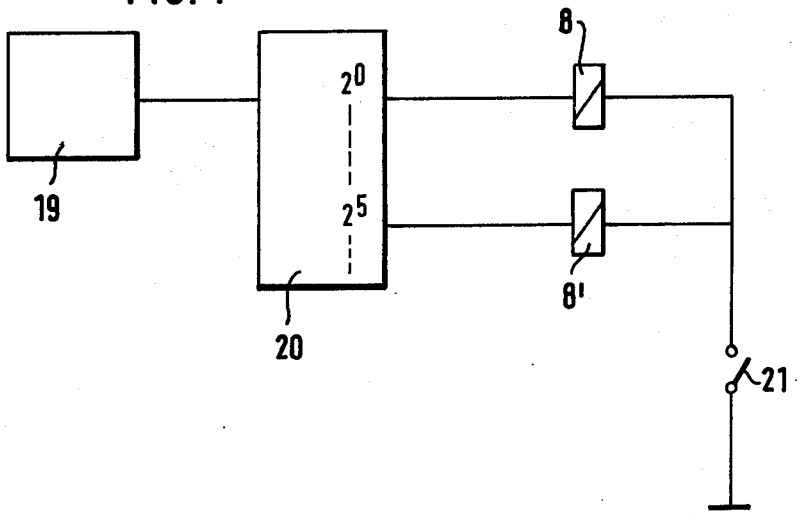

APPARATUS FOR INCREASING IDLING SPEED

The present invention relates to an arrangement (apparatus) for increasing the idling speed of an internal combustion engine, particularly a diesel internal-combustion engine, having a setting member for controlling the feed of the fuel and the path of displacement of which, in the idling direction, can be limited by an idle stop and, after a starting process can be limited by a start-quantity stop, respectively.

In such arrangements there is the problem that when the internal combustion engine is started cold, the idling speed must be increased until the internal combustion engine has become warm. This increase in the idling speed is obtained by an electronic control in known arrangements.

Such an electronic control, however, is costly and very expensive.

The purpose of the present invention is accordingly an arrangement in accordance with the above concept which is of simple construction and economical in manufacture.

This purpose is achieved in accordance with the invention in the manner that the displacement path can be limited by a plurality of start-quantity stops arranged one after the other in the idling direction, of which, beginning with the starting process, at certain time intervals one after the other in each case the start-quantity stop furthest from the idle stop can be moved out of the path of displacement of the setting member. This development of the arrangement makes it possible in simple fashion to obtain increased idle speed after a starting process, the speed being reduced step-wise down to normal operation in a manner corresponding to the average course of the warming-up of the internal combustion engine. In this connection, the setting member may be the displacement lever (3) of the control rod controlling the delivery of a fuel injection pump (2) of, for instance, a diesel internal combustion engine.

If the start-quantity stops are ramps (6, 6′, 6″, 6‴) of different radial length of a cam or swing member (5) which can be driven step-wise with a turning motion, in which connection the idle stop may also be a ramp (6‴) of the cam or swing element (5), then only a few mechanical parts and only a single drive are necessary for this.

If the swing element (5) can be turned by 360°, then after the end of the starting operation, the position from which a new starting interval can directly start again is then automatically again assumed.

Only a small amount of space is required if the swing element (5) is a disk arranged in the plane of movement of the displacement lever (3).

One possibility for the rotary drive of the swing element consists of an electrical stepping motor.

A substantially cheaper rotary drive for the swing element (5) is obtained with a crank drive (7) since it makes a cheaper linear drive possible.

If the crank drive (7) has two levers (9, 10) arranged at an angle to each other and articulated to each other at their one end and if it is connected in the region of the connected ends of the levers with the swing element (5) eccentrically to the axis of rotation of the latter, the free lever ends being adapted to be driven in approximately linear movement independently of each other, then a rotary drive of the swing element in four steps can be obtained in simple fashion with two linear drives.

In this connection, the free lever ends are preferably movable towards and away from each other.

Simple, cheap drives are obtained if the free lever ends are movable by an electromagnetic setting element. For this purpose, the electromagnetic setting elements may be hinged-armature relays (8,8′) the one free end of the levers being articulated to their respective hinged armatures (13, 13′).

The unambiguous course of the setting element in one direction of swing can be assured by unequal restoring forces of the two hinged armatures (13, 13′).

For transmission of the movement of the crank drive to the swing element, the crank drive (7) can be provided, in the region of the interconnected lever ends, with a guide pin (11) which engages into a connecting-link guide (12) of the swing element (5).

The drive for the crank drive (7) can be controlled by an electronic system which has a pulse transmitter (19) which can be turned on by the starting process and the output of which is connected to a counting unit (20) via whose first output a first electromagnetic setting element, which retains its control position for a certain period of time, can be controlled while via its second output a second electromagnetic setting element, which retains its control position for a certain period of time, can be controlled. This drive can be produced with the use of simple, standard components and thus cheaply. In this connection, the first setting element is adapted to be controlled preferably by the counting unit (20) directly after the starting process and then, displaced in time therefrom, the second setting element can be controlled before the end of the control time of the first setting element, the control time of the second setting element extending beyond the control time of the first setting element.

If a temperature switch (21) which is in open position above a given operating temperature of the internal combustion engine (1) is present in the ground connection of the electromagnetic setting elements then, when the internal combustion engine is already warm, the normal idling speed will be directly set. This is necessary, for instance, if the internal combustion engine, after lengthy operation, was shut off for only a short period of time and is thus still at operating temperature when it is again started. An idling speed which is too high for this condition of operation will thus be avoided.

With the above and other objects and advantages in view, the present invention will become more clearly understood in connection with the detailed description of a preferred embodiment, when considered with the accompanying drawings, of which:

Figure 2:
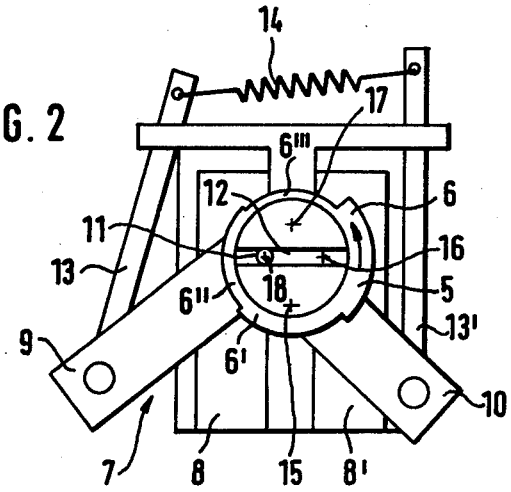
FIG. 2 shows an arrangement in accordance with the invention in front view.

FIG. 3 and FIG. 3*a* show a timing diagram for the arrangement of FIG. 2; and

FIG. 4 is an electric circuit of the arrangement of FIG. 2.

Figure 1:
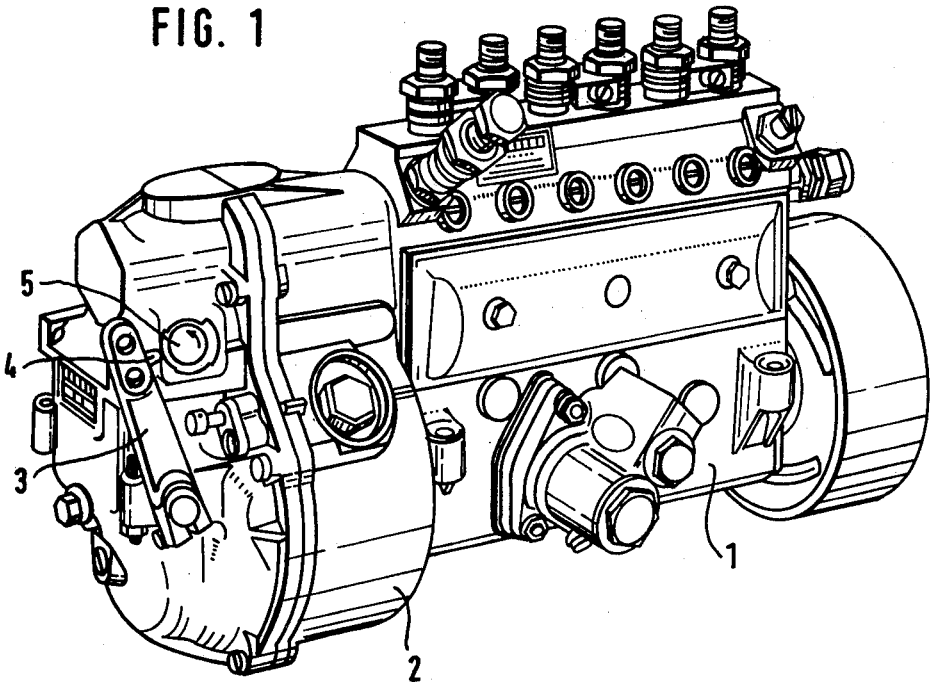
FIG. 1 shows a diesel internal-combustion engine with the arrangement in accordance with the invention.

FIG. 1 shows a diesel internal-combustion engine 1 with a fuel injection pump 2. In order to adjust its delivery, the fuel injection pump has a swingable displacement lever 3. This displacement lever 3 has a stop projection 4 which can be brought against a swing element 5, developed as a disk, arranged in the same plane as the displacement lever 3. Said swing element 5 limits the path of swing of the displacement lever 3 in the idling direction.

The arrangement shown in FIG. 2 has the same swing element 5 as shown in FIG. 1. It consists of a disk which is turnable by 360° and bears, uniformly distributed on its radially surrounding periphery, four ramps 6, 6', 6'', 6''' of different radial size. The ramps 6–6''' are developed successively smaller in clockwise direction starting from the ramp 6 of largest radial size down to the ramp 6''' of smallest radial size.

This ramp 6''' at the same time forms the idle stop when the internal combustion engine 1 is operating at normal operating temperature.

A crank drive 7 which can be actuated by two hinged-armature relays 8 and 8' serves to drive the swing element 5. The crank drive 7 consists of two levers 9 and 10 arranged at an angle to each other and pivoted to each other at their one end. At the pivot point of the levers 9 and 10 there is fastened a protruding guide pin 11 of the crank drive 7 which engages into a diagonal connecting-link guide 12 of the swing element 5.

The free ends of the levers 9 and 10 of the crank drive 7 are articulated to one end of the hinged armatures 13 and 13' of the hinged-armature relays 8 and 8'. The other ends of the hinged armatures 13 and 13', developed as double-armed levers, are connected with each other via a tension spring 14 so that the hinged armatures 13 and 13' are swung away from the relays when the relays are without current, as is the case in connection with the hinged-armature relay 8 shown on the left. The hinged armature relay 8' shown on the right is in the position attracting the hinged armature 13' which it has when it is under current.

When the hinged-armature relays 8 and 8' are completely without current, the slide pin 11 is at the point 15 which corresponds to the normal position at the operating temperature of the internal combustion engine 1.

By the arrangement of the hinged-armature relays 8 and 8' resting against each other as shown in the drawing and due to the crank drive which is arranged flat above same and the swing element 5 which is also arranged flat above same, there is obtained an extremely compact construction of slight structural size so that even subsequent installation into the vehicle may be possible without problems.

Upon the commencement of the starting of the cold internal combustion engine 1, the guide pin 11 moves from the point 15 to the point 16 and after the passage of a certain amount of time to the point 17, then again after a certain period of time to the point 18, and finally back to the point 15. In this connection the guide pin 11 which extends into the connecting-link guide 12 moves the swing element 5 in four 90° sections or a total of 360°.

The hinged-armature relays 8 and 8' are for this purpose controlled by the electronic system shown in FIG. 4 in a manner corresponding to the timing diagrams shown in FIGS. 3 and 3*a*. FIG. 3 corresponds to the hinged-armature relay 8 and FIG. 3*a* to the hinged armature relay 8'. The switch position of the relays 8 and 8' is plotted over time in the diagrams.

Before a starting-up process, both hinged armatures 13 and 13' are in position swung away from the relays 8 and 8' respectively. If a starting process is now commenced then pulses are fed by a pulse transmitter 19 to a counting unit 20, developed as binary counter. This counting unit 20 immediately gives off a signal to the hinged-armature relay 8 which shifts into its attracted switch position, as can be noted at the time T1 in diagram 3. This position is retained for a certain period of time since the hinged-armature relays 8 and 8' are in each case held for some time.

When the internal-combustion engine 1 is cold, the temperature switch 21 which is arranged in the ground connection of the relays 8 and 8' is closed.

Upon the commencement of the starting process, the counting unit 20 also commences to count, giving off a signal upon $2^5$ pulses to the hinged-armature relay 8' which then, at the time T2, switches into its attracted switch position.

Upon the further passage of time, at the time T3 the end of the holding time of the hinged-armature relay 8 is reached so that the hinged armature 13 drops back into its starting position.

At the time T4 the holding time of the hinged-armature relay 8' has also expired so that the hinged armature 13' also moves back into its starting position and in this way the idle position at normal operating temperature is reached.

Should the normal operating temperature be reached before the end of the time sequence described, then the temperature switch 21, which switches as a function of the temperature of the internal combustion engine 1, opens, as a result of which the hinged-armature relays 8 and 8' are no longer under current and the hinged armatures 13 and 13' drop into their starting position.

Since each relay 8 and 8' is constructed in a well-known manner to hold itself on for a predetermined amount of time, output signals from the first and sixth stages of the counting unit means 20 are applied, respectively, to the relays 8 and 8' via a well-known capacitive coupling (not shown) to trigger the relays 8 and 8'.

In the event that the relays 8 and 8' are constructed without holding circuits, then the counting unit means 20 comprises a pair of counters operated in phase quadrants with respect to their most significant bits, the most significants bits of the counters being connected directly to respectively ones of the relays 8 and 8'.

While we have disclosed several embodiments of the invention it is to be understood that these embodiments are given only by example only and not in a limiting sense.

We claim:

1. In an arrangement for increasing the idling speed of an internal combustion engine having a setting member for controlling the feed of fuel thereto and wherein the path of displacement of the setting member can be limited in the idling direction by means of an idle stop and after a starting operation by a start-quantity stop, respectively, the improvement wherein the means for limiting the displacement path includes a plurality of start-quantity stops arranged one behind the other in the idling direction, and means for moving the start-quantity stop furthest from the idle stop out of the path displacement of the setting member beginning with the starting operation at predetermined time intervals one after the other respectively.

2. The arrangement for increasing the idling speed of an internal combustion engine as set forth in claim 1, wherein the setting member is a displacement lever of a control rod controlling the delivery volume of a fuel injection pump.

3. The arrangement for increasing the idling speed of an internal combustion engine as set forth in claim 2, wherein said fuel injection pump is a fuel injection pump of a diesel internal combustion engine.

4. The arrangement for increasing the idling speed of an internal combustion engine as set forth in claim 1, wherein the stops are formed as ramps of differing radii in a swing element, said swing element being drivable, rotatably step-wise.

5. The arrangement for increasing the idling speed of an internal combustion engine as set forth in claim 4, wherein said idle stop is one of the ramps on said swing element.

6. The arrangement for increasing the idling speed of an internal combustion engine as set forth in claim 4, wherein said swing element is rotatable by 360°.

7. The arrangement for increasing the idling speed of an internal combustion engine as set forth in claim 4, wherein the setting member is a displacement lever, and wherein said swing element is a disc arranged in the plane of movement of the displacement lever.

8. The arrangement for increasing the idling speed of an internal combustion engine as set forth in claim 4, wherein said moving means comprises electric stepping motor means for rotatably driving said swing element.

9. The arrangement for increasing the idling speed of an internal combustion engine as set forth in claim 4, wherein said moving means comprises a rotary drive for the swing element, said drive including a crank drive.

10. The arrangement for increasing the idling speed of an internal combustion engine as set forth in claim 9, wherein said crank drive comprises two crank drive levers arranged angularly relative to each other and articulated to each other at one end thereof defining connected ends and operatively connected in the region of said connected ends of the levers with the swing element eccentrically to the axis of rotation of the latter, said crank drive levers have free ends, and said rotary drive includes means for driving said free ends in approximately linear movement independently of each other.

11. The arrangement for increasing the idling speed of an internal combustion engine as set forth in claim 10, wherein the free ends of the levers are movable towards and away from each other, respectively.

12. The arrangement for increasing the idling speed of an internal combustion engine as set forth in claim 10, wherein the crank drive includes, a connecting-link guide formed in said swing element, and a guide pin guided in said connecting-link guide, said guide is located in the vicinity of the connected ends of the levers.

13. The arrangement for increasing the idling speed of an internal combustion engine as set forth in claim 10, wherein said means for driving said free ends comprises electromagnetic setting element means for moving the free ends of the levers, respectively.

14. The arrangement for increasing the idling speed of an internal combustion engine as set forth in claim 13, wherein the electromagnetic setting element means are hinged-armature relays each having a hinged armature, one of said free ends of each of the levers respectively being articulated to a respective of said hinged armatures of said relays.

15. The arrangement for increasing the idling speed of an internal combustion engine as set forth in claim 14, wherein said hinged armatures are each double arm levers having one end articulated to said free ends of said crank drive levers, respectively, a tension spring is connected to the other ends of said double arm levers.

16. The arrangement for increasing the idling speed of an internal combustion engine as set forth in claim 14, wherein said setting element means include restoring means for applying restoring forces to the two hinged armatures, with the restoring force being unequal.

17. The arrangement for increasing the idling speed of an internal combustion engine as set forth in claim 13, further comprising means comprising an electronic system for controlling said driving means for the crank drive, said electronic system comprising a pulse transmitter which can be switched on by the starting operation, and a counting unit means, the output of the pulse transmitter being connected to said counting unit means, and wherein said setting element means comprise first and second electromagnetic setting elements which retain their respective control positions for predetermined periods of control time, respectively, said first electromagnetic setting element being connected to a first output of said counting unit means and said second electromagnetic setting element being connected to second output of said counting unit means for controlling respectively said first and said second electromagnetic setting elements.

18. The arrangement for increasing the idling speed of an internal combustion engine as set forth in claim 17, wherein said counting unit means for counting pulses of said pulse transmitter, said counting unit means for controlling said first electromagnetic setting element directly after the starting operation and then, displaced in time therefrom, for controlling the second electromagnetic setting element before the end of the control time of the first setting element, the control time of the second setting element extending beyond the control time of the first setting element.

19. The arrangement for increasing the idling speed of an internal combustion engine as set forth in claim 17, further comprising an electrical ground for said electromagnetic setting elements, and a temperature switch means disposed in the ground connection of the electromagnetic setting elements, said temperature switch means for being in open position above a predetermined operating temperature of the internal combustion engine to deactivate said elements.

20. The arrangement for increasing the idling speed of an internal combustion engine as set forth in claim 17, wherein said counting unit means is a binary counter.

* * * * *